US008191684B1

(12) United States Patent
Dammann

(10) Patent No.: US 8,191,684 B1
(45) Date of Patent: Jun. 5, 2012

(54) LADDER MOUNTED BRUSH APPARATUS

(76) Inventor: David R. Dammann, Port Orchard, WA (US)

( * ) Notice: Subject to any disclaimer, the term of this patent is extended or adjusted under 35 U.S.C. 154(b) by 207 days.

(21) Appl. No.: 12/782,151

(22) Filed: May 18, 2010

(51) Int. Cl.
*A46B 15/00* (2006.01)

(52) U.S. Cl. ..... 182/129; 15/161; 15/237

(58) Field of Classification Search ..... 182/129; 15/161, 237
See application file for complete search history.

(56) References Cited

U.S. PATENT DOCUMENTS 1,479,644 A * 1/1924 Browne ..... 280/169
1,515,449 A * 11/1924 Vose ..... 280/169
2,904,127 A * 9/1959 Sarno ..... 182/129
3,028,617 A 4/1962 Racina
D375,039 S * 10/1996 Carroll ..... D8/354
D381,138 S 7/1997 Taylor
6,032,316 A 3/2000 Peake et al.
6,898,817 B1 5/2005 Jackson
7,513,519 B2 4/2009 Sharpe
2005/0251939 A1* 11/2005 Levingston ..... 15/112
* cited by examiner

*Primary Examiner* — Alvin Chin Shue

(57) ABSTRACT

The ladder mounted brush apparatus provides for ladder safety with a removably mounted device that affixes to the lower rung of a ladder, adjacent to the ladder rail. Upon beginning to climb the ladder, a user steps downwardly on the brush bristles and base to position the base and bristles atop the rung, moving the base and bristles and attachment plate from parallel to the ladder rail to a position atop the rung, perpendicular to the rail. The user then weights alternates feet to scrub footwear soles, thereby cleaning the footwear to ensure against slipping on the ladder rungs. Upon cessation of use, the attachment plate with attached brush base with bristles automatically returns to a position immediately adjacent to the ladder rail, thereby out of the way of ladder ascension and dissention.

2 Claims, 4 Drawing Sheets

LADDER MOUNTED BRUSH APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Ascending and descending a ladder, with dirty or muddy footwear is hazardous at best. The present apparatus provides a basic means for cleaning footwear at the onset of ladder usage.

FIELD OF THE INVENTION

The ladder mounted brush apparatus relates to ladders and the safety in their use and more especially to spring loaded hinged brush that mounts to a ladder rung to clean a user's footwear prior to ladder ascension.

SUMMARY OF THE INVENTION

The general purpose of the ladder mounted brush apparatus, described subsequently in greater detail, is to provide a ladder mounted brush apparatus which has many novel features that result in an improved ladder mounted brush apparatus which is not anticipated, rendered obvious, suggested, or even implied by prior art, either alone or in combination thereof.

To attain this, the ladder mounted brush apparatus provides for ladder safety with a removably mounted device that affixes to the lower rung of a ladder, adjacent to the ladder rail. Upon beginning to climb the ladder, a user steps downwardly on the brush bristles and base to position the base and bristles atop the rung, moving the base and bristles and attachment plate from parallel to the ladder rail to a position atop the rung. The user then alternates feet to scrub footwear soles, thereby cleaning the footwear to ensure against slipping on the ladder rungs. Upon cessation of use, the attachment plate with attached brush base with bristles automatically returns to a position immediately adjacent to the ladder rail, thereby out of the way of ladder ascension and dissention. The dimensions of the apparatus are critical so that the apparatus functions properly and also retreats to a position that does not interfere with ladder use. The automatic pivot of the attachment plate with attached brush base and bristles to a position parallel to one of the ladder's rails is critical to ensure that the brush base and bristles in no way interfere with ladder use.

Thus has been broadly outlined the more important features of the improved ladder mounted brush apparatus so that the detailed description thereof that follows may be better understood and in order that the present contribution to the art may be better appreciated.

An object of the ladder mounted brush apparatus is to aid in ladder use safety.

Another object of the ladder mounted brush apparatus is to be easily used.

A further object of the ladder mounted brush apparatus is to automatically retract when not in use.

An added object of the ladder mounted brush apparatus is to be easily attached and detached.

These together with additional objects, features and advantages of the improved ladder mounted brush apparatus will be readily apparent to those of ordinary skill in the art upon reading the following detailed description of presently preferred, but nonetheless illustrative, embodiments of the improved ladder mounted brush apparatus when taken in conjunction with the accompanying drawings.

In this respect, before explaining the current embodiments of the improved ladder mounted brush apparatus in detail, it is to be understood that the ladder mounted brush apparatus is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved ladder mounted brush apparatus. It is therefore important that the claims be regarded as including such equivalent constructions insofar as they do not depart from the spirit and scope of the ladder mounted brush apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the ladder mounted brush apparatus generally designated by the reference number 10 will be described.

Figure 1:
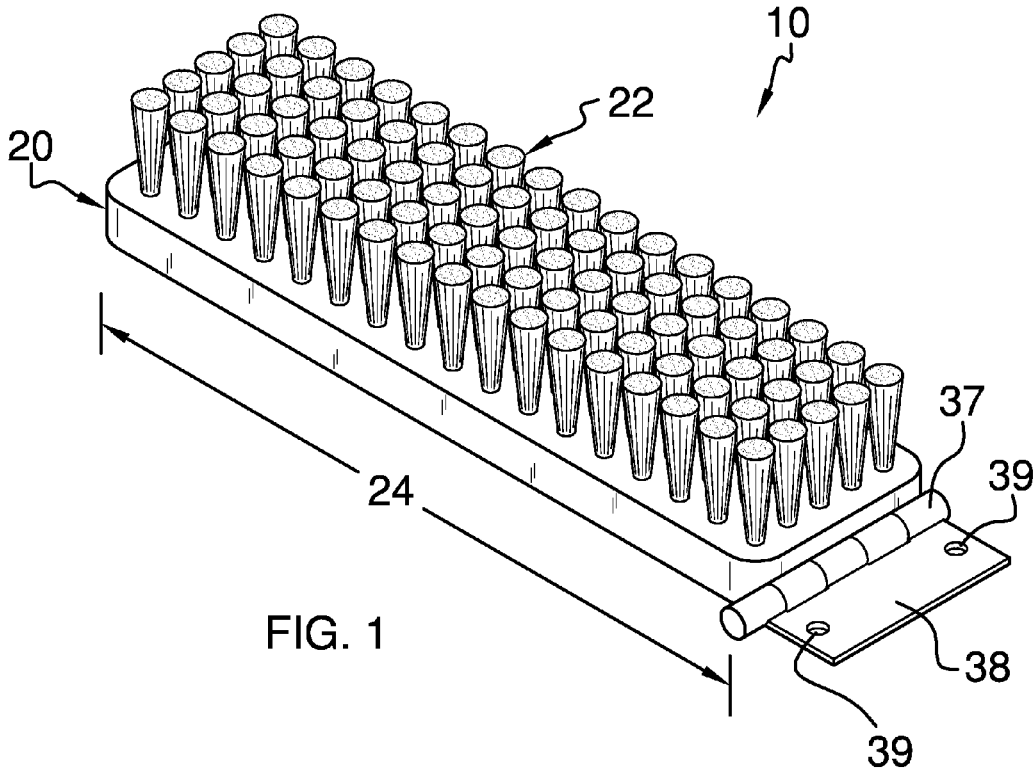
FIG. 1 is a perspective view.

Referring to FIG. 1, the apparatus 10 partially comprises the rectangular brush base 20 having a base length 24 of about 11 inches. A plurality of bristles 22 is perpendicularly affixed to the brush base 20.

Figure 2:
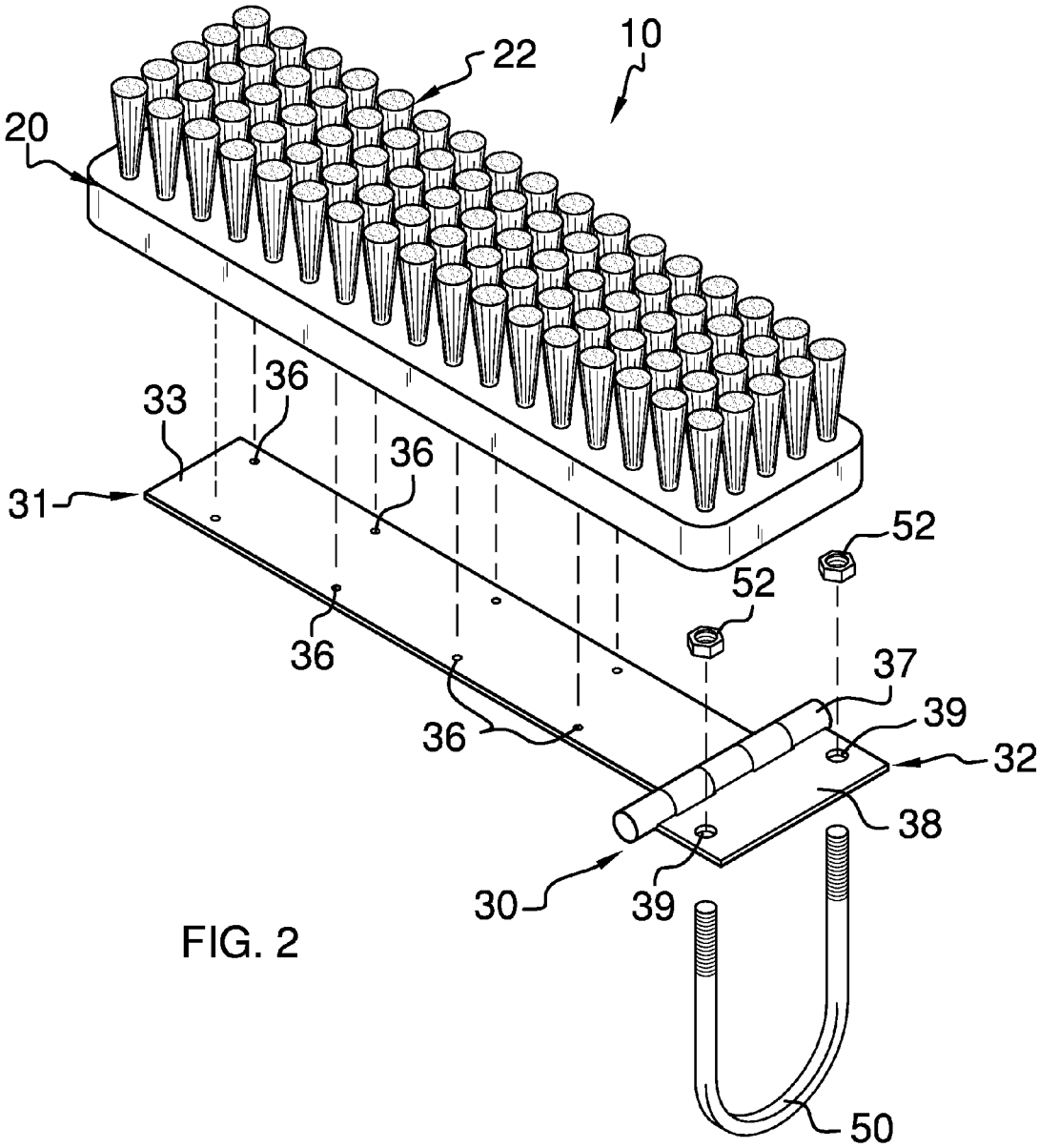
FIG. 2 is a perspective view, disassembled.

Referring to FIG. 2, the hinged attachment 30 is removably fastened to the brush base 20, opposite the bristles 22. The hinged attachment 30 has a first end 31 spaced apart from the second end 32.

Figure 3:
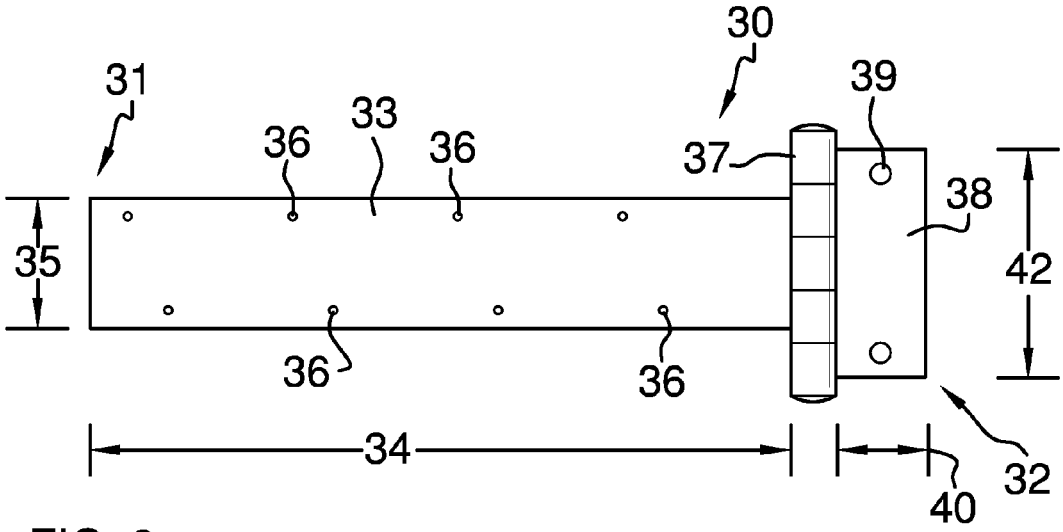
FIG. 3 is a top plan view of the hinged attachment.

Referring to FIG. 3, the hinged attachment 30 partially comprises an attachment plate 33 having a plate length 34 of about 10¾ inches and a plate depth 35 of about 2 inches. A plurality of spaced apart plate orifices 36 is disposed within the attachment plate 33 and provide for attachment to the brush base 20. The spring loaded barrel hinge 37 is affixed to the attachment plate 33 proximal to the second end 32. The extension 38 is affixed to the hinge 37 opposite the attachment plate 33. The extension 38 has an extension length 40 of about 1⅜ inches and an extension depth 42 of about 3½ inches.

Figure 4:
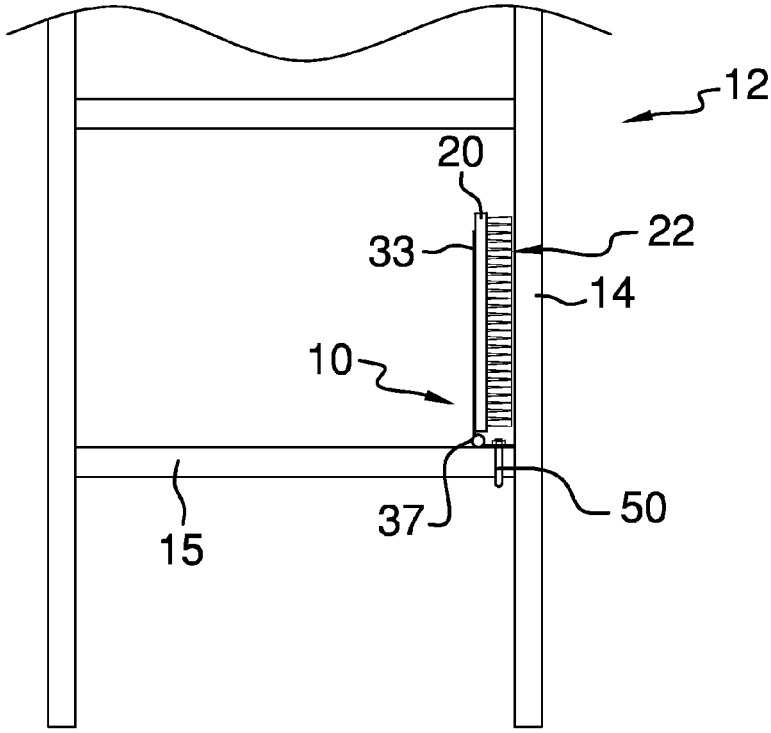
FIG. 4 is a front elevation view of the apparatus mounted to the lowest ladder rung, brush retracted to the ladder rail.
Figure 5:
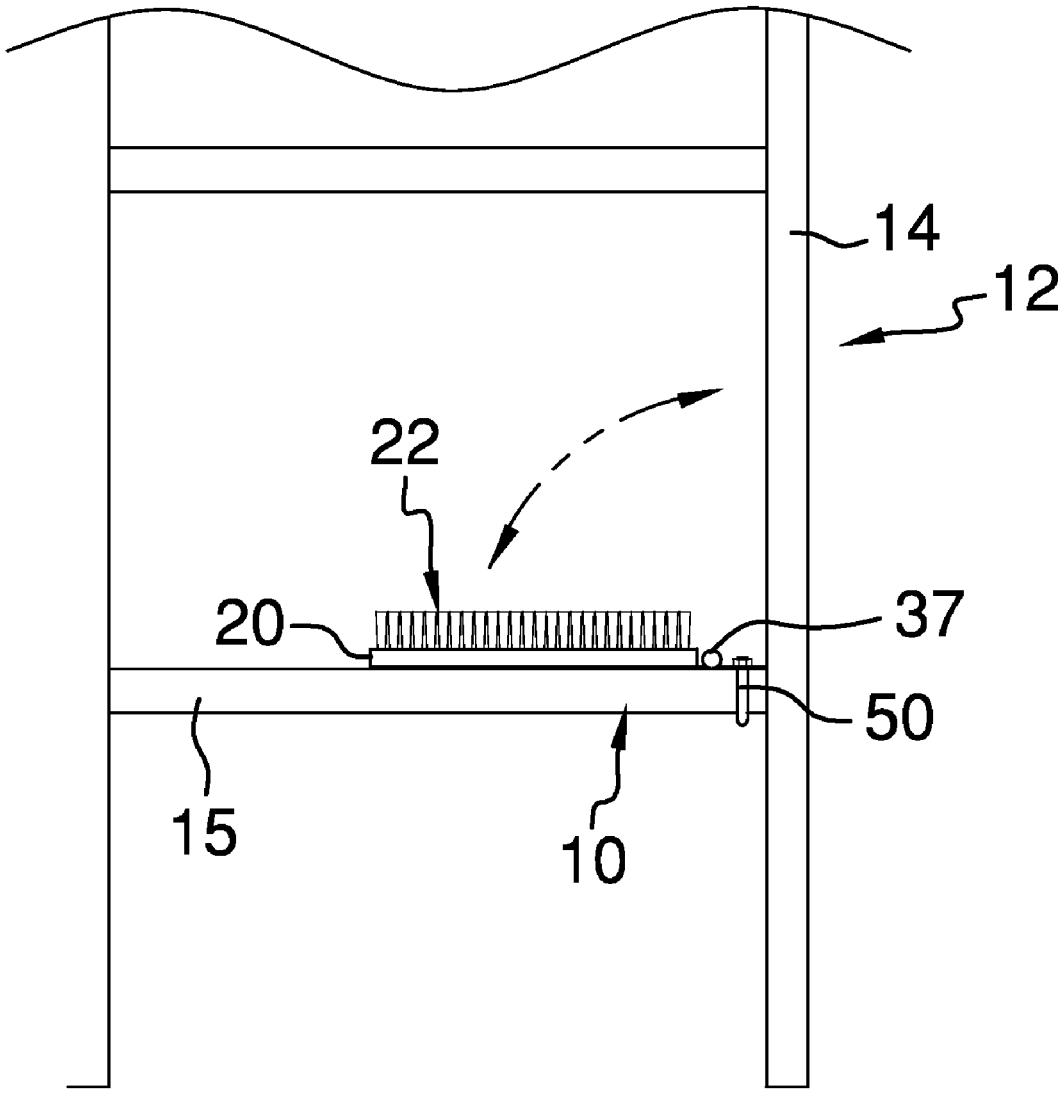
FIG. 5 is a front elevation view of the apparatus mounted to the lowest rung and pivoted for use.

Referring to FIG. 4, the spring loaded barrel hinge 37 automatically returns the attachment plate 33 with attached brush base 20 with bristles 22 to a position perpendicular to the extension 38. The pair of spaced apart extension orifices 39 of about 5/16 inches diameter is disposed within the extension 38.

Referring to FIG. 5 and again to FIG. 2, the u-bolt 50 of about 5/16 inches diameter is removably inserted around an existing rung 15 of an existing ladder 12, adjacent to an existing rail 14. The u-bolt 50 is then inserted through the extension orifices 39. The pair of nuts 52 removably affixes the u-bolt 50 atop the ladder rung 15.

Referring again to FIGS. 4 and 5, a user steps on the brush base 20 to pivot the attachment plate 33 with attached brush base 20 and bristles 22 to a position atop and parallel to the lowest rung 15. Upon cessation of use, the attachment plate 33 is automatically returned to parallel to the ladder 12 rail 14 and thereby presents no obstruction to ladder 12 use.

With respect to the above description then, it is to be realized that the optimum dimensional relationships for the parts of the ladder mounted brush apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the ladder mounted brush apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the ladder mounted brush apparatus may be used.

Therefore, the foregoing is considered as illustrative only of the principles of the ladder mounted brush apparatus. Further, since numerous modifications and changes will readily occur to those skilled in the art, it is not desired to limit the ladder mounted brush apparatus to the exact construction and operation shown and described, and accordingly, all suitable modifications and equivalents may be resorted to, falling within the scope of the ladder mounted brush apparatus.

What is claimed is:

1. A ladder mounted brush apparatus comprising, in combination:

a rectangular brush base;

a plurality of bristles perpendicularly affixed to the brush base;

a hinged attachment removably fastened to the brush base, opposite the bristles, the hinged attachment having a first end spaced apart from a second end, the hinged attachment comprising:

an attachment plate;

a plurality of spaced apart plate orifices disposed within the attachment plate;

a spring loaded barrel hinge affixed to the attachment plate proximal to the second end;

an extension affixed to the hinge, opposite the attachment plate;

whereby the spring loaded barrel hinge automatically returns the attachment plate with attached brush base and bristles to a position perpendicular to the extension;

a pair of spaced apart extension orifices disposed within the extension;

a u-bolt removably inserted around an existing rung of an existing ladder, adjacent to an existing rail, the u-bolt then inserted through the extension orifices;

a pair of nuts removably affixing the u-bolt atop the ladder rung.

2. A ladder mounted brush apparatus comprising, in combination:

a rectangular brush base having a base length of about 11 inches;

a plurality of bristles perpendicularly affixed to the brush base;

a hinged attachment removably fastened to the brush base, opposite the bristles, the hinged attachment having a first end spaced apart from a second end, the hinged attachment comprising:

an attachment plate having a plate length of about 10¾ inches, and a plate depth of about 2 inches;

a plurality of spaced apart plate orifices disposed within the attachment plate;

a spring loaded barrel hinge affixed to the attachment plate proximal to the second end;

an extension affixed to the hinge, opposite the attachment plate, the extension having an extension length of about 1⅜ inches and an extension depth of about 3½ inches;

whereby the spring loaded barrel hinge automatically returns the attachment plate with attached brush base and bristles to a position perpendicular to the extension;

a pair of spaced apart extension orifices of about 5/16 inches diameter disposed within the extension;

a u-bolt of about 5/16 inches diameter removably inserted around an existing rung of an existing ladder, adjacent to an existing rail, the u-bolt then inserted through the extension orifices;

a pair of nuts removably affixing the u-bolt atop the ladder rung.

* * * * *